US005904277A

United States Patent [19]

Niedermeyer

[11] Patent Number: 5,904,277

[45] Date of Patent: May 18, 1999

[54] METHOD AND APPARATUS FOR TRANSVERSE FOLDING OF ARTICLES

[76] Inventor: William P. Niedermeyer, 1024 Mt. Mary Dr., Green Bay, Wis. 54311

[21] Appl. No.: 08/799,238

[22] Filed: Feb. 14, 1997

Related U.S. Application Data

[63] Continuation-in-part of application No. 08/598,368, Feb. 8, 1996, Pat. No. 5,795,433.

[51] Int. Cl.[6] ..... A41D 1/00; A41H 33/00; D05B 35/00

[52] U.S. Cl. ..... 223/37; 223/1; 493/416

[58] Field of Search ..... 223/37, 38, 1; 156/475, 477.1, 479, 517, 520, 521, 212, 226, 227; 493/416

[56] References Cited

U.S. PATENT DOCUMENTS

| | | |
|---|---|---|
| 3,689,061 | 9/1972 | Nystrand . |
| 3,823,935 | 7/1974 | Guichard . |
| 3,870,292 | 3/1975 | Bradley . |
| 4,003,775 | 1/1977 | Batt . |
| 4,055,859 | 11/1977 | Green . |
| 4,160,423 | 7/1979 | Scholl . |
| 4,266,112 | 5/1981 | Niedermeyer . |
| 4,289,493 | 9/1981 | Hedrich . |
| 4,316,756 | 2/1982 | Wilson . |
| 4,328,655 | 5/1982 | Spencer . |
| 4,347,955 | 9/1982 | Kamal . |
| 4,425,173 | 1/1984 | Frick . |
| 4,448,626 | 5/1984 | Off . |
| 4,549,916 | 10/1985 | Off . |
| 4,699,302 | 10/1987 | Papajewski . |
| 5,211,320 | 5/1993 | Hubele . |
| 5,795,433 | 8/1998 | Niedermeyer ..... 156/479 |

*Primary Examiner*—Daniel Stemmer

[57] ABSTRACT

The machine of the present invention makes single or double transverse folds in segments cut from a continuous web. It includes feeder and cutter mechanisms to transfer segments to the surface of a central folding drum. A controlled vacuum source selectively applies vacuum to leading and trailing portions of the segments during advancement and folding. Segment portions are held by vacuum applied through ports arranged in pre-selected patterns that include transverse fold lines. An air blast directed through apertures in the drum surface urges leading portions of the segment upward to project radially before fold completion by contact with a stationary plate. Air blast can be used alone or in combination with mechanical means to complete the folds. Selective placement and operation of vacuumized ports and air blast apertures in combination with mechanical means are used to achieve multiple transverse folds.

18 Claims, 4 Drawing Sheets

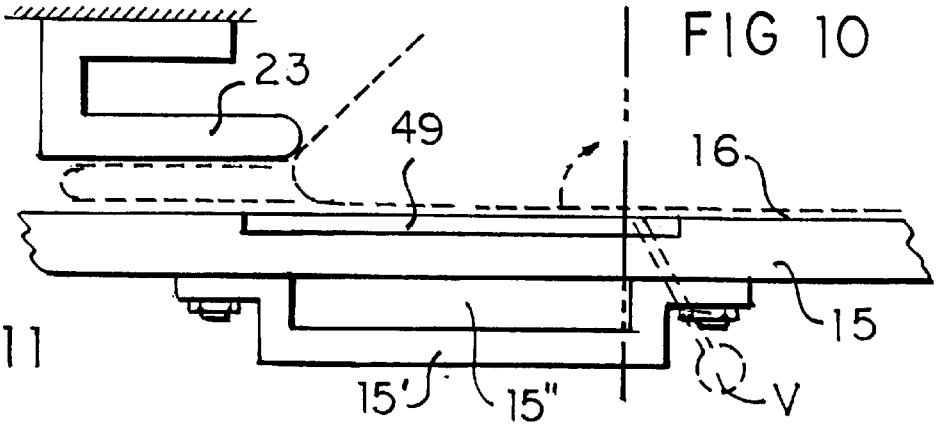
FIG 10
FIG 11
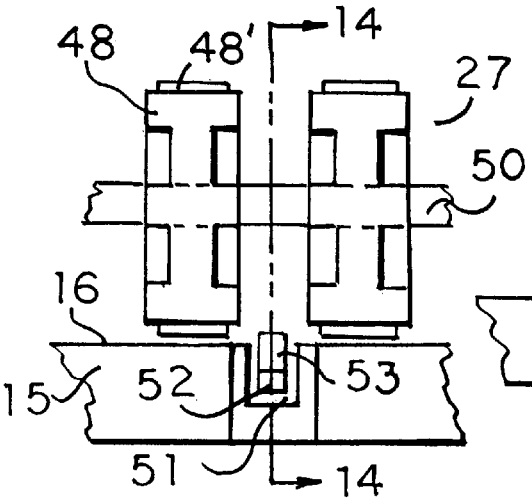
FIG 12
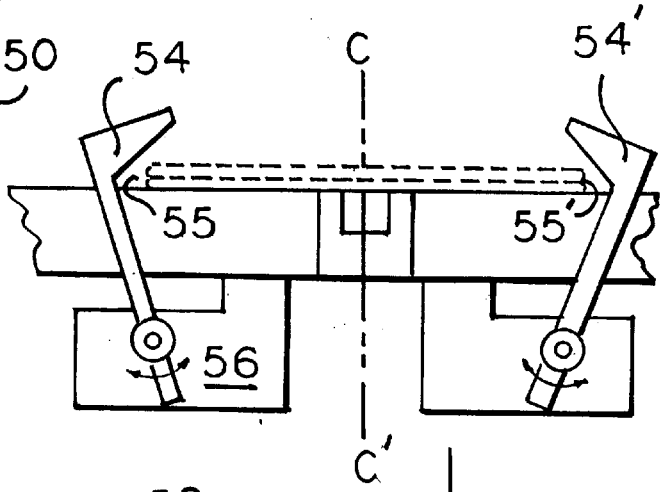
FIG 13
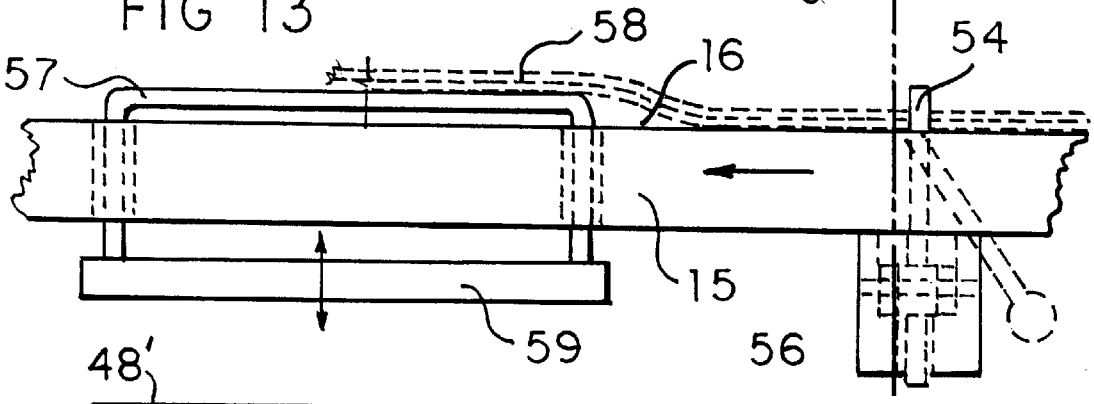
FIG 14
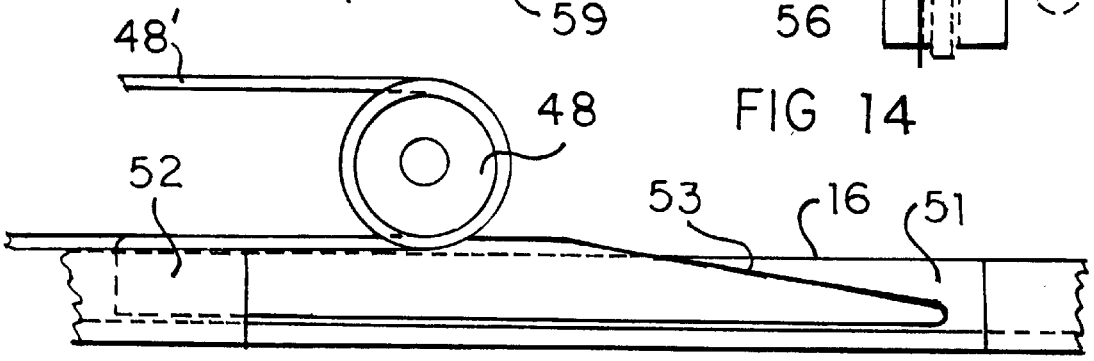

METHOD AND APPARATUS FOR TRANSVERSE FOLDING OF ARTICLES

BACKGROUND AND SUMMARY OF THE INVENTION

The inventive article folding apparatus and method is a continuation-in-part of U.S. application No. 08/598,368 filed Feb. 8, 1996, now U.S. Pat. No. 5,795,433 which describes apparatus and methods for folding and seaming articles of apparel made from a continuous web of material.

Different machine lines for different garments use the folding/seaming apparatus of the patent teaching. The folding/seaming apparatus includes platens (bearing areas) shaped like the garment and mounted at spaced intervals around a rotating central drum.

A series of first segments matching the platen size and shape but having 'flap' extensions along several margins is die cut from the web, and one segment is in register with, and placed on each platen.

A second series of segments having substantially the same size and shape as the platen is then superposed on the first segment and after adhesive is applied to margins of the outward facing second segment, the extended flaps are folded over to entrap the second segment, and form a bonded seam. The foldover extensions are about ¾" or even narrower. These seams are made in the longitudinal or transverse direction, or at acute angles to these lines.

The instant invention uses similar components and techniques, but is limited to single transverse cross-folds that bisect the product segment, and if preferred, a second transverse cross fold that substantially bisects the already folded product to produce a folded quarter-length product.

For apparel, bearing areas (platens) are shaped and can be spaced apart so that seam folders and other devices have room to operate along margins of the product.

In the present invention, a continuous web is cut into a series of juxtaposed segments without space therebetween. The segments are placed on the surface of a rotating cylinder or drum that has vacuumized ports arranged substantially in a predetermined patterns to hold the product against the drum surface and are then folded by applying first and secondary positive forces, including air, to complete the singlefold or the doublefold.

With prior art apparatus, vacuum is used to hold the segment against a cylindrical surface, and is also used to provide a negative force to help complete the fold.

This invention requires fewer vacuum rolls, and is able to fold smaller panels, especially those that have been previously folded into a narrow multi-panel web which is cut before transverse folding.

This apparatus can also fold segments of substantial length, such as 24' long towels or folded surgical/medical drapes, etc., and articles of heavier basis weight material.

Vacuum is used to secure trailing panel 34 to the cylinder surface 16 while the fold is being made.

Air blast can be used alone, or in combination with mechanical fingers (see FIGS. 7 and 9), to complete the folds.

Other advantages and objects of the invention may be seen in the ensuing specification.

BRIEF DESCRIPTION OF THE DRAWINGS

FIG. 10 is a cutaway side elevation illustrating an air plenum for folding with a high flow low pressure stream of air viewed as in FIGS. 7 to 9.

FIG. 11 is a cutaway end elevation viewed in the machine direction illustrating the use of a belt to maintain previously completed folds, and stripper bars to disengage the product from the drum.

FIG. 12 is a cutaway end view illustrating clamping side fingers that secure a multi-ply product securely at the fold line while folding.

FIG. 13 is a cutaway side elevation of the clamping device viewed along a transverse fold line like F1—F1' or F2—F2' of FIG. 5 and an elongated panel lifting device which leads the fold line.

FIG. 14 is a cutaway side elevation of the belt device and stripper bars of FIG. 11 and located as shown at the bottom of FIG. 1.

DETAILED DESCRIPTION

Figures 1, 2:
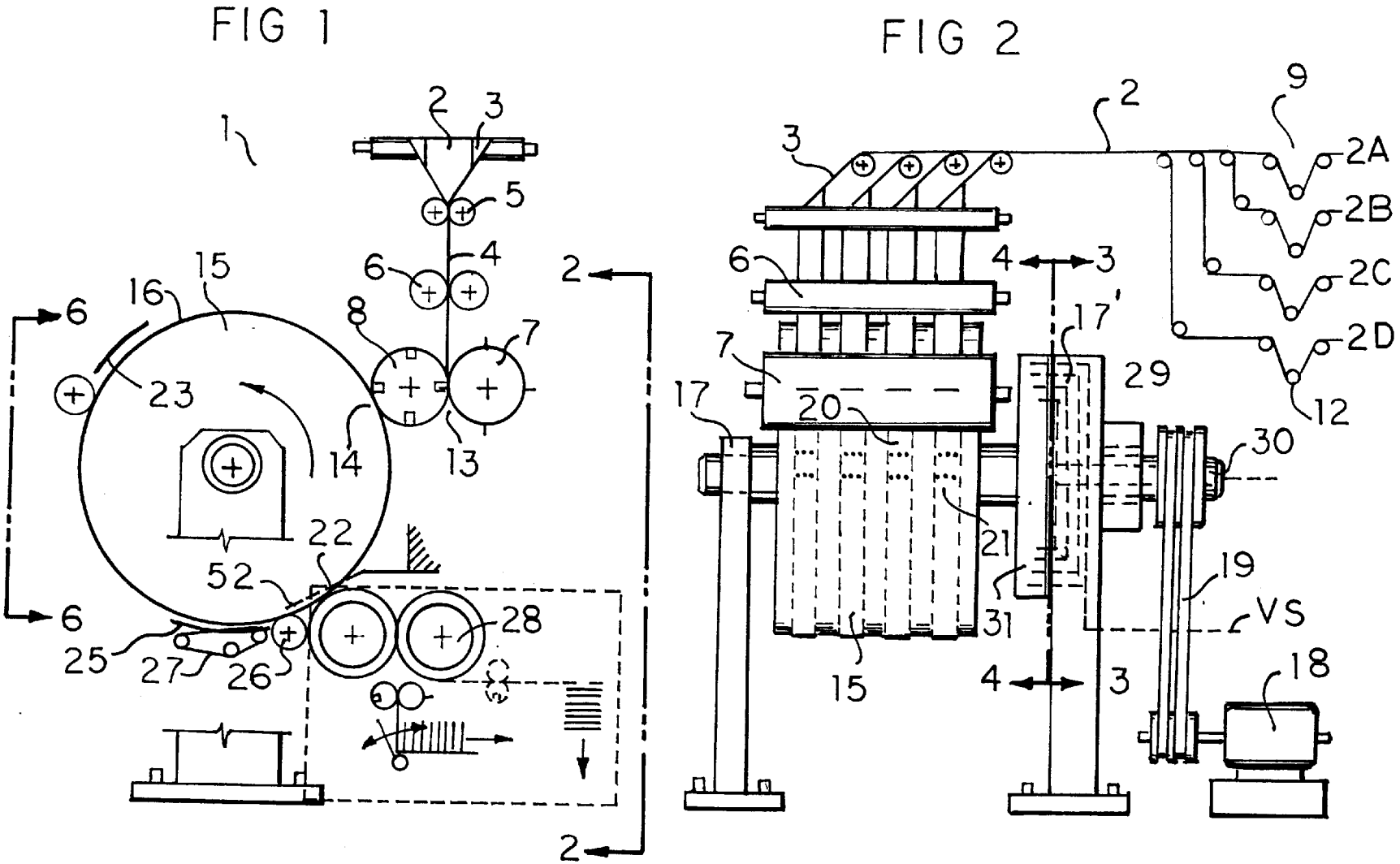
FIG. 1 is a schematic side elevation illustrating the essential components of the invention with optional packaging apparatus shown within phantom lines.
FIG. 2 is an end elevation of the apparatus as viewed from sight line 2—2 of FIG. 1.

FIG. 1 illustrates the present article folding apparatus 1 processing a continuous web 2 shown going over a longitudinal folding plate 3 that folds the web into two equal longitudinal panels 4.

Pull roll sets 5 and 6 have the same surface velocity and feed the folded web into a cutoff roll set that includes knife roll 7 and anvil roll 8. To more clearly describe the apparatus, the description herein is based on producing a short length product, for example, a 4' long wiper product.

Separate rolls of material are unwound in four separate unwind stands. Each web is threaded through a 3-roll constant tension system 9 comprised of two fixed rolls 10 and 11, and a third roll mounted on pivotable arms. The third "dancer" roll 12 moves up or down in response to changes in web tension, and using a pneumatic sensor, actuator device modulates the belt speed of the unwind stand (not shown) as a function of web tension.

Each of the webs passes over folding plates 3 to be folded into two panels as shown, however, different folding plates can be substituted to produce a four panel 'W' fold, 6-panels, etc.

Anvil roll 8 has vacuumized ports which transport the cut segment from nip 14 of cutoff roll set 7–8 and places it on top of selectively positioned vacuum ports in the carrier means 15 referred to hereinafter as the folding roll.

Folding roll 15 is rotatably journaled in a framework 17, and is driven by motor 18 via belt system 19 as shown in FIG. 2.

As the segment progresses counter-clockwise from transfer position 14, it is folded by at least two forces—one that is applied radially upward, and a second force that folds the leading portion of a segment about a fold line as the drum rotates. It is noted that each segment is placed over a plurality of apertures 20 (see FIG. 2) that are aligned transversely and thus, when being vacuumized, define a fold line like F1—F1' in FIG. 5.

In the embodiment described, each 4" cut segment is placed on the folding drum 15 in end-to-end juxtaposition such that each segment is therefore placed centrally over a row of vacuum ports or apertures that define a fold line for each segment. In the apparatus illustrated in FIG. 1, the folding drum 15 has a circumference of 96" and therefore 24 rows of vacuum and (and air) apertures arranged equally around the drum periphery to thus define 24 fold lines like F1—F1' of FIG. 5 for making a single cross fold.

If a double cross fold (transverse folds) is preferred, a second set of 24 rows of vacuum apertures 21 would be drilled through the drum shell, and each would be positioned half way between two consecutive F1—F1' fold lines. The second fold lines are designated F2—F2' in FIG. 5 and are positioned on the drum face as shown in FIG. 2.

Referring again to FIG. 1, the 'active' portion of drum rotation during which folding occurs is from the point of segment introduction, as at 14, until the segments are transferred from the drum, as at position 22 of FIG. 1.

In FIG. 1, a stationary plate 23 can be used to complete the foldback, and an 'ironing' roll can press the fold. If the second fold is made using vacuumized apertures 21 to establish the second fold line F2—F2', a second stationary plate 25 can complete the second fold and ironing roll 26 can press it as it passes through the roller nip.

An endless belt assembly 27 can be used to hold marginal portions of a multi-panel longitudinally folded product while the central portion is being stripped from the drum surface near the exit point, as at 22.

The illustrations of FIGS. 7 through 13 show other devices and embodiments used to complete either a single crossfold or double crossfolds. In essense, each fold is completed by applying a first upward positive force to lift the leading portion upward, and a second positive force is applied in a direction opposite to machine direction—all while selected portions of the segment are being held securely against the drum surface 16 by patterns of vacuum holes (see FIG. 5).

In FIG. 1, a stationary stripper bar 52 is used to insure positive removal of the segment for transfer to downstream conveyance or packaging. A packaging arrangement using two heated co-acting sealer rolls 28 can entrap the folded segments in a sealed package that is cut off before packout. Packaging options are numerous, and are removed from FIG. 2 for clarity.

Figure 3:
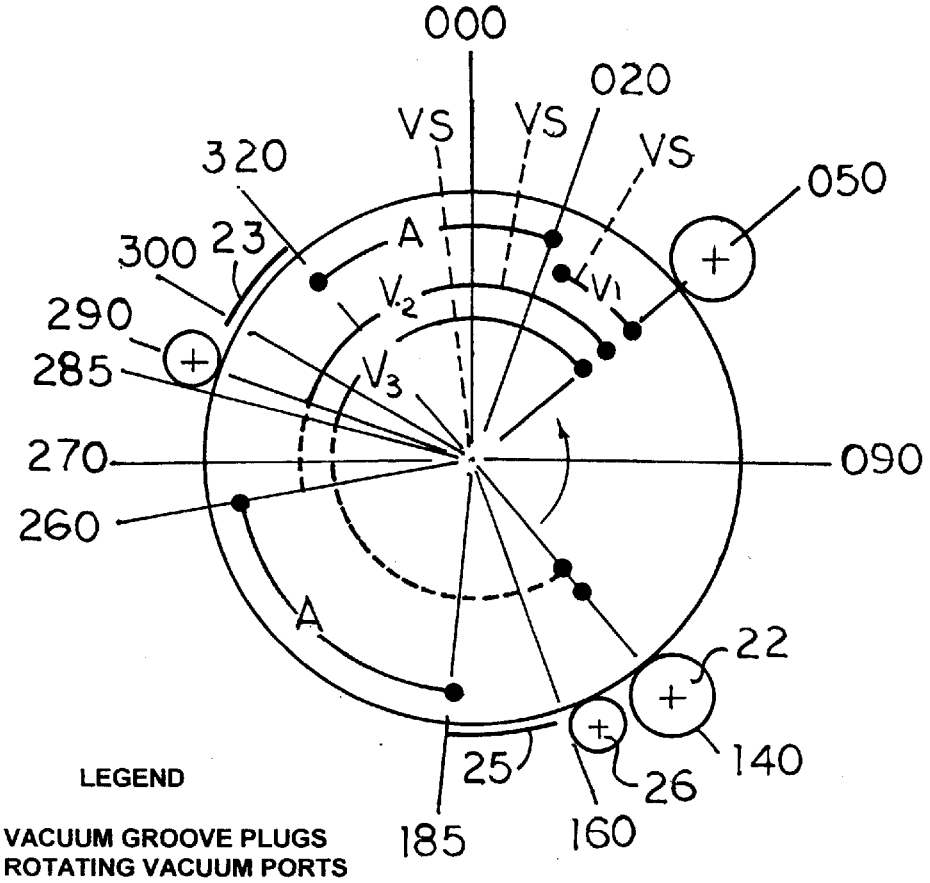
FIG. 3 is a diagrammatic illustration of the vacuum and air grooving in the stationary portion of the vacuum timing valve as viewed from sight line 3—3 of FIG. 2.

FIG. 3 diagramatically shows the vacuum and air grooving and indicates the groove portions to which vacuum is applied by a remote vacuum source Vs (not shown). The effective length of a vacuum groove is established by the distance between two plugs that block the passages. FIG. 3 shows the vacuum groove length and the timing—see degree references required for completion of a double fold on a series of segments as they rotate around the drum from transfer positions 14 to 22. FIG. 3 illustrates the vacuum groove arrangements on the face of the non-rotating valve half 17' (shown as framework), with connections to the active portion of each vacuum groove identified as V1, V2, and V3 respectively. Note that the 'active' portion of each groove communicates with a remote vacuum source Vs through channel 29 and a hollow shaft 30. Vacuum in the grooves then communicate with patterns of vacuum holes in the drum surface, (see patterns of FIG. 5) by co-active face-to face rotating connections made by the vacuum ports on the rotating half 31 of the vacuum valve combination 17'–31. Piping or tubing from member 31 and the apertures in the drum are omitted for clarity.

Figure 5:
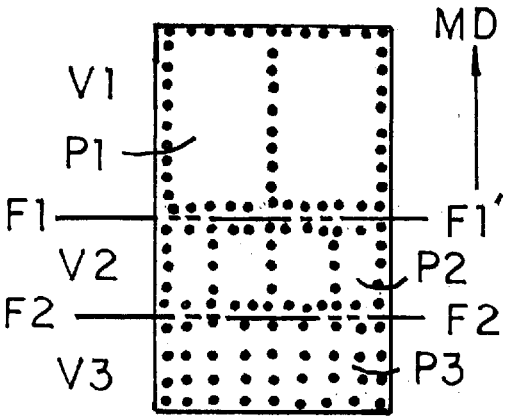
FIG. 5 is a plan view of a typical product illustrating various panels of the product before folding and a typical arrangement of vacuum apertures.
Figure 4:
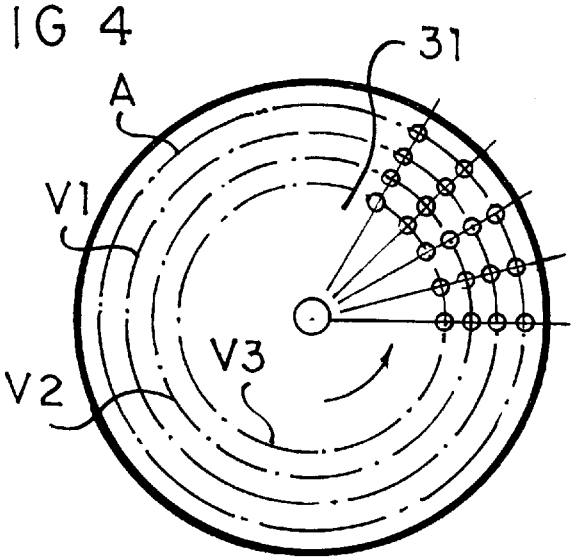
FIG. 4 is a diagrammatic illustration of the vacuum and air ports in the rotating portion of the vacuum valve.

To further describe actual operation, the vacuum sequence and timing is described relative to FIGS. 3, 4, and 5 for completion of a double transverse crossfold.

Vacuum V1, V2, and V3 start at 050 degrees of FIG. 3 and are applied to the segment as shown in FIG. 5 (channel tubing ommited). Groove Vi in the stationary piece 17' (FIG. 2) is in coacting relationship with rotating ports in valve half 31 from 050 to 020 degrees at which position V1 stops so that folding of the leading panel P1 can begin.

From 020 to 320 degrees, vacuum V1 is inoperative, with V2 and V3 operative to hold the rear panels P2 and P3 against the drum. Air pressure (or mechanical means ) is applied to fold the front portion P1 upward, and at position 320 degrees, stationary plate 23 completes the fold.

After ironing from 320 to 300 degrees, a second fold can be made, but only after vacuum V2 is disengaged from the leading quarter panel P2 of FIG. 5 while panel P3 remains held against the drum.

From about 290 to 260 degrees, vacuum, V2 and V3 hold the rear quarter panels P2 and P3 until the second fold begins. At 260 degrees, the lead quarter-panel vacuum V2 stops so that a fold over line F2—F2' can be made by air pressure while V3 vacuum continues to hold the last quarter panel securely to the drum, until completion 22 at rotation reference 140 degrees.

During rotation from 260 to 140 degrees, stationary plate 25 and ironing roll 26 perform functions as described for the singlefold portion of the sequence.

FIG. 4 shows that the rotating portion 31 of the co-acting members 17' and 31 has three vacuum ports and one air hole (port) for each 4" of folding drum travel. The air port is a functional component for various air jet nozzle and/or plenum arrangements described herein relative to FIGS. 6 through 10.

Figure 6A:
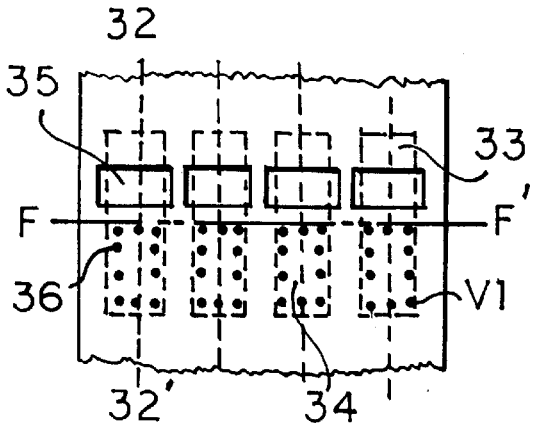
FIGS. 6A–6D illustrate different arrangements of vacuum apertures and cutouts used for air blast means to achieve part of the folding function, as viewed on the face of the folding drum from sight line 6—6 of FIG. 1.

In FIG. 6A, the location each web segment on the drum surface is shown by parallel dashed lines 32—32'. A product comprised of front half panel 33 and rear half panel 34 is shown in phantom positioned equally about fold line F—F' and arranged with the major dimension in the machine direction. Cutouts 35 under the front half panel allow air or mechanical folding means to impinge against, and be operative on, the front half panel 33 while a pattern of vacuum ports 36 holds the rear half panel 34 to the drum surface during fold completion by application of the earlier described first and second positive folding forces.

Figure 6B:
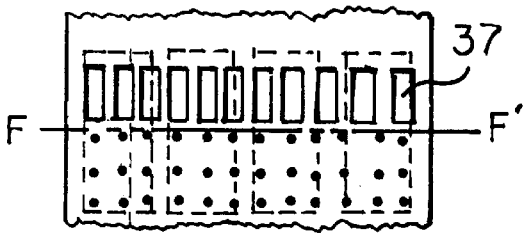
Figure 6C:
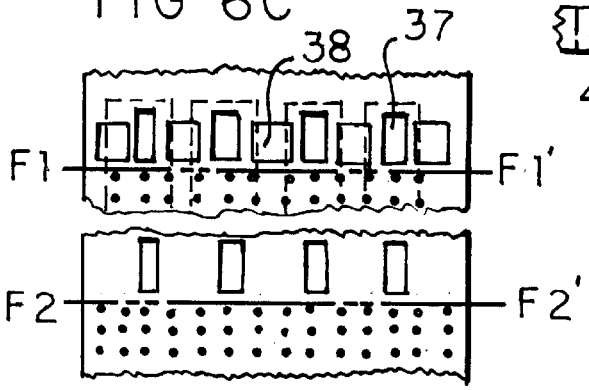
Figure 6D:
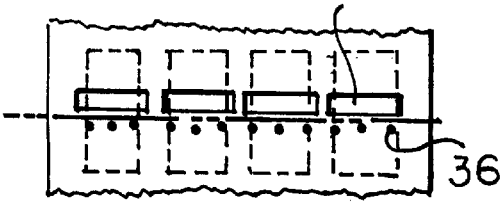

In FIG. 6D, only vacuum apertures in close proximity to fold line F—F' are shown. With other apertures omitted for clarity.

FIG. 6B shows a plurality of cutouts which allows air blast to fold the leading panel portion 33 upward.

FIG. 6C shows slot cutouts 37 aligned centrally of each product with each product path, for subsequent folding of lead panels. In this location, cutouts 37 would allow at least one mechanical finger 39 (see FIG. 7) to fold along a transverse fold line. Adjacent cutouts 38 with screen cover 49 (see FIG. 10) allow high volume air flow to assist with the upward fold (as a first positive upward force.

Figure 7:
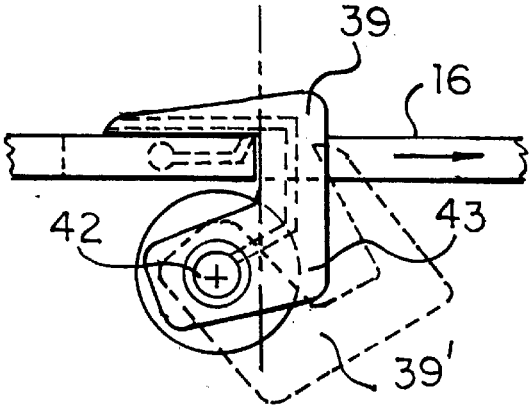
FIG. 7 is a cutaway side elevation of rotary mechanical fingers with air blast apertures that are viewed in the direction of transverse fold lines like F1—F1' and/or F2—F2' of FIGS. 5 and 6A–6D.
Figure 9:
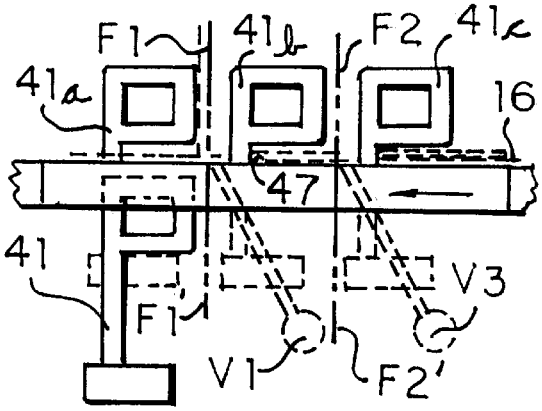
FIG. 9 is a cutaway side elevation illustrating movable fingers that can apply vertical upward, horizontal, and downward vertical forces for folding.

FIG. 6D shows transverse slots 40 in close proximity to the fold line to permit high pressure air jets and/or mechanical fingers 39 of FIG. 7 or 41 of FIG. 9 to produce the first upward force. In FIG. 6D, the location of a product is shown in phantom with fold line F—F' bisecting the product equally for a typical quarterfolded product. A plurality of vacuum ports 36 holds the product in place while it is being folded.

In FIG. 7, inverted L shaped fingers 39 are mounted on rotatable hollow shaft 42 which can be pressurized to assist in the application of the first upward positive force, and as the finger rotates to force the foldover to occur, the air jets also help the fingers to achieve the transition to, and application of, the second force at right angles and parallel with the drum surface. Phantom lines show the finger in the inactive position 39'. For a second fold, the length of arm 43 is increased to compensate for the extra thickness of the double folded and/or multi-ply product.

Figure 8:
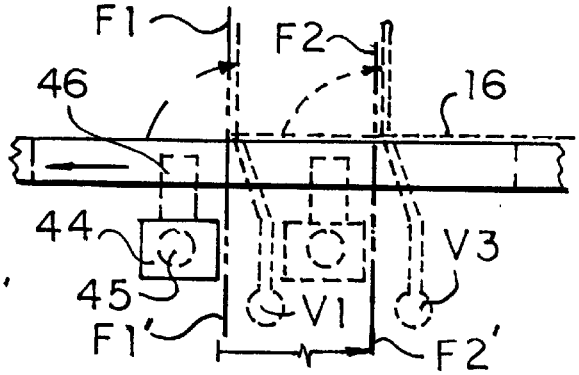
FIG. 8 is a cutaway side elevation illustrating an air jet device that operates along a first fold line and is moved to a second position along a second fold line.

In FIG. 8, air jet arrangements are for a double fold, whereby a movable member 44 is repositioned from location near F1—F1' to a second position near F2—F2' (moving means not shown). Vacuum ports that establish F1—F1' location are shown as communicating with V1. While making the second fold along line F2—F2', the rear quarter panel is held by vacuum V3.

Movable member 44 has a high pressure manifold 45 that pressures air jet 46 at both positions. With this movable arrangement air jets can be momentarily turned off during movement of member 44 or a separate and additional air groove could be added to rotating valve half 31.

FIG. 9 shows a 'P' shaped finger in the starting position 41. Moving from 41 to 41*a* imparts the first upward positive force. From 41*a* to 41*b* the second positive force parallel to the drum surface 16 is applied as needed to complete the first transverse foldback, as at 47.

Moving the fingers from 41*b* to 41*c* occurs after a predetermined drum rotation, during which time movement of the fingers and mounting carriage must be reversed to lower them and reposition the fingers under the second panel before fingers can be raised to 41*b* and continue with movement to 41*c* for completion of the double transverse fold.

In FIG. 10 a member 15' creates an air plenum 15" directly under screen 49 which is mounted flush with drum surface 16. High volumes of low pressure air lifts large panels upward whence they can be folded back by contact with externally mounted plate 23.

In FIG. 11, endless belts 48' of assembly 27 are mounted on pulleys 48 for rotation on shaft 50.

Belts are shown straddling longitudinal slot 51. A stripper bar 52 with inclined surface 53 extends above surface 16 of drum 15.

In FIG. 1, stripper bar 52 is shown at product exit position 22.

When longer products having multiple plies are being cross folded, especially those with multiple panel folds, or when the material being folded has has low permeability, the panels away from the drum surface may not be securely held by the vacuum patterns of FIG. 5. As shown in FIG. 12, the outer panels can be held securely along the fold line by using side mounted fingers 54. Fingers 54 are actuated at the proper rotary location and move toward the product centerline, thus clamping top panels at each side margin 55 and 55'.

After panel folds are completed, fingers 54, 54' are pivoted to unclamp the product, and prior to reaching product exit position 22, mounting members 56, 56' move downwardly to avoid interference between fingers 54, 54' and roll 26. It is understood that as the leading half panel of a product is in the lower half of the drum rotation, disengagement of the vacuum will allow the lead half panel to drop down, and using air or other means, complete the second force fold.

When large panels are being folded, high volume air flow is advantageous, but because plenum length is limited by rotational speed (and time), elongated supporting bars 57 are moved upward to lift position 58 before or during air blast from the plenum 15 (not shown). Fingers 57 must be moved below the surface 16 of drum 15 hence, the mounting block 59 is arranged for radial movement (actuators not shown).

FIG. 14 illustrates the arrangement and positioning of stripper bars 52, continuous cutout 51, belts 48, etc, which function as described above.

While in the foregoing specification a detailed description of an embodiment of the invention has been set forth for the purpose of explanation, any variations can be made in the details stated herein without departing from, or limiting, the spirit and scope of the invention.

Having thus described the invention, I claim:

1. An article folding apparatus comprising:

a web advancing means, means to cut segments from said web, means to transport at least one of said segments to a carrier means, said carrier means moving in a path having a beginning and an end, said carrier means including a surface with cutouts for movement and operation of folding devices said carrier means surface having a plurality of vacuum apertures arranged to hold a plurality of said segments in juxtaposed end-to-end relationship against the surface of said carrier, said vacuum apertures arranged in at least two predetermined patterns, a vacuum source communicating with said vacuum apertures, at least one of said pattern of apertures arranged to hold the leading half portion of said segment on one side of a first fold line, and, at least one of said patterns arranged to hold the trailing half portion of said segment on the other side of said first fold line, said carrier including means to apply a first positive force to fold said leading half portion of said segment outward from the carrier surface, and, including means to apply a second positive force to fold said leading half portion into superposed relationship with said trailing half portion, said first force means being operative through at least one cutout in said carrier surface, and means to remove the folded article from said carrier as said carrier approaches the end of said path.

2. The apparatus of claim 1 wherein the surface of said carrier is circular and continuous except for said apertures and said cutouts.

3. The apparatus of claim 1 wherein one of said patterns of apertures holds a portion of said trailing half portion, and a third pattern of apertures holds a different portion of said trailing half portion, said trailing half portion being bisected by a second fold line.

4. The apparatus of claim 1 wherein an additional first force means and an additional second force means are used to complete a second fold about a second fold line.

5. The apparatus of claim 4 wherein said first force means includes a member that is movable in a direction opposite to the machine direction for positioning said member in close proximity to said second fold line.

6. The apparatus of claim 1 wherein said second positive force means is stationary and not rotatable about the axis of said carrier.

7. The apparatus of claim 1 wherein at least one of said forces is applied by pressurized air.

8. The apparatus of claim 1 wherein said first force means is applied by a member that rotates about a transverse line in close proximity to said fold line and, by rotational transition, applies said second positive force.

9. The apparatus of claim 1 wherein said first force means is derived from an air passage that is contained in a member that rotates about a transverse line in close proximity to said fold line.

10. The apparatus of claim 1 wherein said cutouts include an air plenum having a curvilinear air pervious surface substantially contiguous with the surface of the carrier drum.

11. The apparatus of claim 1 wherein said fold line is aligned with, and projects across, said cutouts.

12. The apparatus of claim 1 wherein said cutouts are aligned in a transverse direction in close proximity to said fold line.

13. The apparatus of claim 1 wherein the major dimension of at least one of said cutouts is parallel to the machine direction.

14. The apparatus of claim 1 wherein an endless belt provides said second folding force.

15. The apparatus of claim 1 wherein said positive first force is applied by a member elongated in the machine direction wherein said member is movable radially and cooperates with an air pressure force to complete partial segment foldover about a transverse fold line.

16. The apparatus of claim 1 wherein fingers rotatable along a line parallel to the machine direction are mounted for clamping the trailing half portion in close proximity to said fold line, and after foldback of the leading half portion of said segment, said fingers being disengageable and movable radially below the surface of said carrier.

17. The apparatus of claim 14 wherein said endless belt is vacuumized.

18. A method of folding a segment including the steps of:

advancing a web of material, folding said web longitudinally, cutting said folded web into juxtaposed segments, transporting said segments in end to end relationship to the surface of a carrier, holding a portion of at lest one of said segments against the surface of said carrier with vacuum operative through a plurality of apertures, a portion of said apertures located along a transverse line, applying vacuum to said aperture portion while applying a first positive force outward from the carrier and applying a second force that is substantially opposite to the direction of carrier movement to complete at least one transverse fold of said at least one segment, and, removing said folded segment from the surface of said carrier.

* * * * *